US011498195B2

(12) United States Patent
Akiba

(10) Patent No.: US 11,498,195 B2
(45) Date of Patent: Nov. 15, 2022

(54) DRIVING TOOL

(71) Applicant: MAKITA CORPORATION, Anjo (JP)

(72) Inventor: Yoshitaka Akiba, Anjo (JP)

(73) Assignee: MAKITA CORPORATION, Anjo (JP)

( * ) Notice: Subject to any disclaimer, the term of this patent is extended or adjusted under 35 U.S.C. 154(b) by 254 days.

(21) Appl. No.: 16/892,994

(22) Filed: Jun. 4, 2020

(65) Prior Publication Data

US 2020/0391366 A1 Dec. 17, 2020

(30) Foreign Application Priority Data

Jun. 17, 2019 (JP) ..... JP2019-112272

(51) Int. Cl.

| | |
|---|---|
| ***B25C 1/06*** | (2006.01) |
| ***B25F 5/00*** | (2006.01) |
| ***B25F 5/02*** | (2006.01) |
| *B25C 1/00* | (2006.01) |

(52) U.S. Cl.

CPC ..... *B25C 1/06* (2013.01); *B25F 5/001* (2013.01); *B25F 5/02* (2013.01); *B25C 1/003* (2013.01)

(58) Field of Classification Search

CPC ..... B25C 1/06; B25F 5/001; B25F 5/02
See application file for complete search history.

(56) References Cited

U.S. PATENT DOCUMENTS

| | | | | |
|---|---|---|---|---|
| 7,997,467 | B2 * | 8/2011 | Hirabayashi | B25C 1/06 227/156 |
| 8,136,606 | B2 * | 3/2012 | Krondorfer | B25C 1/06 173/1 |
| 10,926,385 | B2 * | 2/2021 | Myers | B25B 21/002 |
| 2006/0261125 | A1 * | 11/2006 | Schiestl | B25C 1/06 227/133 |
| 2008/0257933 | A1 * | 10/2008 | Takahashi | B25C 1/06 227/129 |
| 2009/0032567 | A1 * | 2/2009 | Liang | B25C 1/06 227/131 |
| 2009/0289094 | A1 * | 11/2009 | Schiestl | B25C 1/008 227/8 |
| 2010/0116863 | A1 * | 5/2010 | Suda | B25C 1/06 227/8 |

(Continued)

FOREIGN PATENT DOCUMENTS

JP 2018-012187 A 1/2018

*Primary Examiner* — Nathaniel C Chukwurah
*Assistant Examiner* — Lucas E. A. Palmer
(74) *Attorney, Agent, or Firm* — Oliff PLC

(57) ABSTRACT

A driving tool includes a tool body, a flywheel, a driver, a pressing mechanism and a solenoid. The solenoid has an actuation part configured to linearly move in a specified direction from an initial position when the solenoid is activated. The pressing mechanism includes a holder turnably supported around a rotation axis relative to the tool body, and a roller rotatably supported by the holder. The holder is turnable between a first position in which the roller is apart from the driver and a second position in which the roller abuts on the driver and presses the driver toward the flywheel to thereby enable transmission of the rotational energy to the driver. The actuation part is configured to turn the holder from the first position to the second position while moving from the initial position.

16 Claims, 18 Drawing Sheets

(56) References Cited

U.S. PATENT DOCUMENTS

| | | | | |
|---|---|---|---|---|
| 2011/0094847 | A1* | 4/2011 | Hirabayashi | B25C 1/06 192/105 R |
| 2014/0076951 | A1* | 3/2014 | Brendel | B25C 1/06 227/8 |
| 2014/0076952 | A1* | 3/2014 | Garber | B25C 1/06 227/129 |
| 2014/0088753 | A1* | 3/2014 | Lim | B25F 5/021 700/168 |
| 2014/0097223 | A1* | 4/2014 | Baron | B25C 1/06 227/129 |
| 2018/0001454 | A1* | 1/2018 | Jaskot | B25C 1/06 |
| 2018/0001455 | A1* | 1/2018 | Meyer | B25C 1/008 |
| 2018/0001456 | A1* | 1/2018 | Garber | B25C 1/06 |
| 2018/0015600 | A1* | 1/2018 | Akiba | B25C 1/06 |
| 2019/0366527 | A1* | 12/2019 | Akiba | B25C 5/15 |
| 2020/0039044 | A1* | 2/2020 | Akiba | B25C 1/06 |
| 2020/0276691 | A1* | 9/2020 | Akiba | B25C 1/008 |
| 2020/0306941 | A1* | 10/2020 | Akiba | B25C 1/04 |
| 2020/0391366 | A1* | 12/2020 | Akiba | B25F 5/001 |

* cited by examiner

DRIVING TOOL

CROSS-REFERENCE TO RELATED APPLICATION

The present application claims priority to Japanese patent application No. 2019-112272 filed on Jun. 17, 2019, contents of which are fully incorporated herein by reference.

TECHNICAL FIELD

The present disclosure relates to a driving tool which is configured to drive a fastener into a workpiece with a driver.

BACKGROUND ART

A driving tool is known which is configured to strike a fastener such as a nail and drive the fastener into a workpiece by linearly moving a driver. For example, in a driving tool disclosed in Japanese Unexamined Patent Application Publication No. 2018-12187, a lever is actuated by a solenoid to push the driver forward from an initial position. When the driver reaches a transmitting position located forward of the initial position, the driver is pushed out forward at high speed by rotational energy transmitted from a flywheel, and drives out a nail from a nose part.

SUMMARY

The present disclosure herein provides a driving tool which is configured to drive a fastener into a workpiece. The driving tool includes a tool body, a flywheel, a driver, a pressing mechanism and a solenoid.

The flywheel is housed in the tool body. The driver is disposed to face an outer periphery of the flywheel. The driver is configured to linearly move forward from an initial position along a moving axis by rotational energy transmitted from the flywheel, thereby striking and driving the fastener into the workpiece. The moving axis of the driver defines a front-rear direction of the driving tool. The pressing mechanism is disposed on a side opposite to the flywheel across the driver in a facing direction in which the flywheel and the driver face each other. The solenoid has an actuation part. The actuation part is configured to linearly move in a specified direction from an initial position when the solenoid is activated.

The pressing mechanism includes a holder and a roller. The holder is turnably supported around a rotation axis relative to the tool body. The roller is rotatably supported by the holder. The holder is turnable between a first position and a second position. The first position of the holder is a position in which the roller is apart from the driver. The second position of the holder is a position in which the roller abuts on the driver and presses the driver toward the flywheel to thereby enable transmission of the rotational energy to the driver. The actuation part is configured to move the holder from the first position to the second position while moving from the initial position.

DETAILED DESCRIPTION OF THE EMBODIMENTS

An embodiment is now described with reference to the drawings. In the present embodiment, a nailing machine 1 is described as an example of a driving tool. The nailing machine 1 is a tool which is capable of performing a nailing operation of driving a nail 101 into a workpiece (such as wood) by linearly driving out the nail 101 from an outlet 120.

Figure 1:
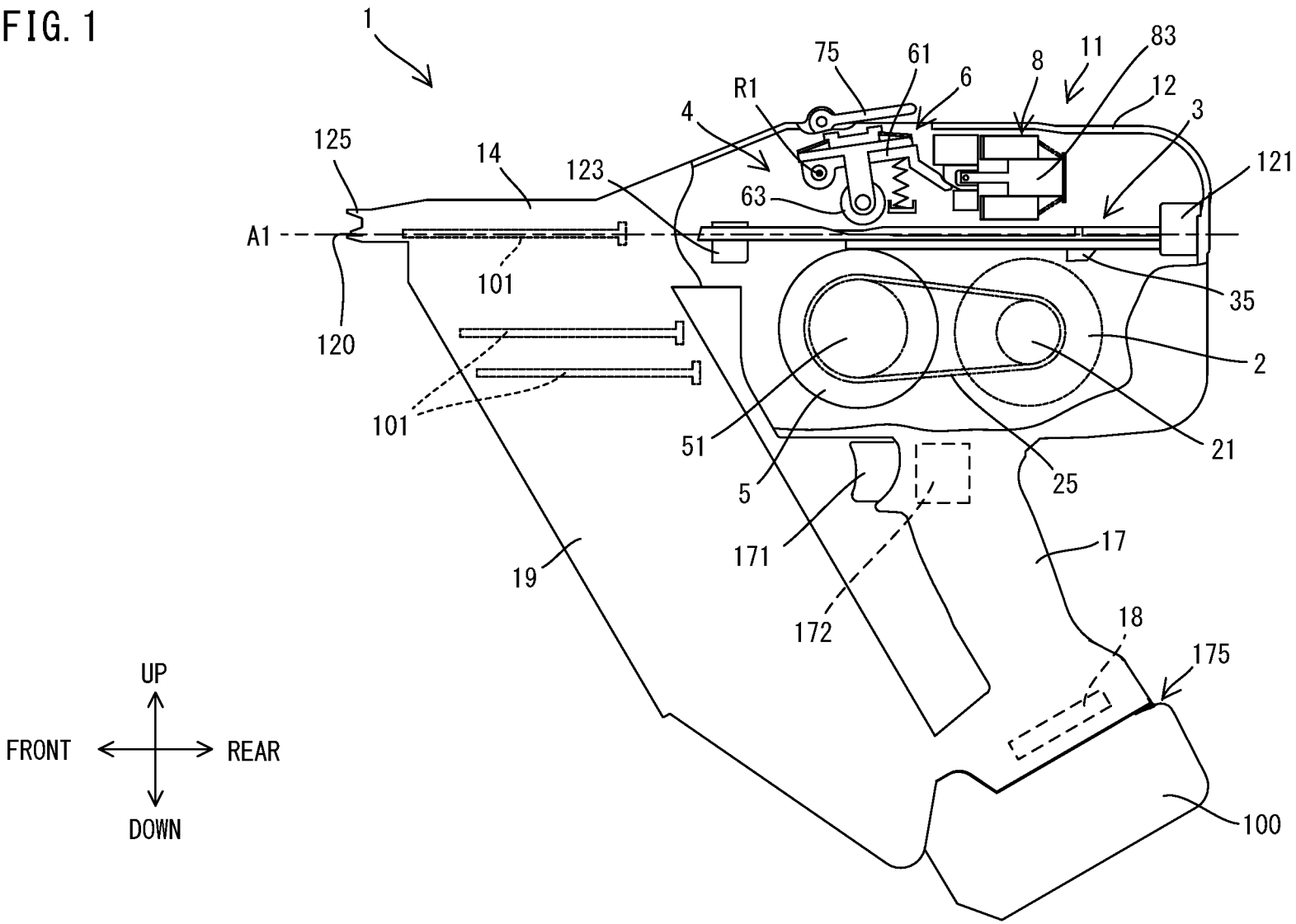
FIG. 1 is an explanatory drawing showing the overall structure of a nailing machine when a driver is located in an initial position.

First, the general structure of the nailing machine 1 is described with reference to FIG. 1. As shown in FIG. 1, an outer shell of the nailing machine 1 of the present embodiment is mainly formed by a tool body 11, a handle 17 and a magazine 19.

The tool body 11 includes a body housing 12 and a nose part 14.

The body housing 12 houses a motor 2, a driver-driving mechanism 4 including a flywheel 5, a driver 3, and a return mechanism (not shown). The flywheel 5 is configured to be rotationally driven by the motor 2 to store rotational energy. The driver 3 is disposed to face an outer periphery of the flywheel 5, and configured to linearly move along a moving axis A1 by rotational energy transmitted from the flywheel 5, and drive a nail 101 into a workpiece. The return mechanism is configured to return the driver 3 to an initial position after the nail 101 is driven out.

The nose part 14 is connected to one end of the body housing 12 in an extending direction of the moving axis A1 (hereinafter simply referred to as a moving-axis-A1 direction). The nose part 14 has a driver passage (not shown)

which extends through the nose part 14 in the moving-axis-A1 direction. One end of the driver passage is open to the inside of the body housing 12. The other end of the driver passage is open to the outside of the nailing machine 1 to form an outlet 120, through which the nail 101 may be driven out. A contact arm 125 is held on the nose part 14, adjacent to the outlet 120. The contact arm 125 is movable in the moving-axis-A1 direction. Further, a switch (not shown) is disposed within the body housing 12. The switch is configured to be normally kept in an OFF state, and to be switched to an ON state when the contact arm 125 is pressed.

The handle 17 is connected to a central portion of the body housing 12 in the moving-axis-A1 direction, and extends in a direction crossing the moving axis A1. The handle 17 is a portion to be held by a user. A trigger 171 is provided in a base end portion (an end portion connected to the body housing 12) of the handle 17 and configured to be depressed by a user. A switch 172 is disposed within the handle 17. The switch 172 is configured to be normally kept in an OFF state, and to be switched to an ON state when the trigger 171 is depressed. Further, a battery-mounting part 175 having terminals is provided on a distal end portion (an end portion opposite to the base end portion) of the handle 17. A rechargeable battery 100 is removably mounted to the battery-mounting part 175. Further, a controller 18 for controlling operation of the nailing machine 1 is disposed inside the distal end portion of the handle 17.

The magazine 19 is configured to be loaded with a plurality of nails 101 and mounted to the nose part 14. The nails 101 loaded in the magazine 19 are fed one by one to the driver passage by a nail-feeding mechanism (not shown). The structure of the magazine 19 is well known and therefore its description is omitted.

The detailed structure of the nailing machine 1 is now described. In the following description, for convenience sake, the moving-axis-A1 direction of the driver 3 (a left-right direction as viewed in FIG. 1) is defined as a front-rear direction of the nailing machine 1. In the front-rear direction, the outlet 120 side (a left side as viewed in FIG. 1) of the tool body 11 is defined as a front side of the nailing machine 1, while its opposite side (a right side as viewed in FIG. 1) is defined as a rear side. Further, a direction (an up-down direction as viewed in FIG. 1) which is orthogonal to the moving axis A1 and which corresponds to the extending direction of the handle 17 is defined as an up-down direction of the nailing machine 1. In the up-down direction, the side (an upper side as viewed in FIG. 1) on which the handle 17 is connected to the tool body 11 (the body housing 12) is defined as an upper side, while the side (a lower side as viewed in FIG. 1) of the distal end portion (the end portion on which the battery 100 is mounted) of the handle 17 is defined as a lower side. Further, a direction which is orthogonal to the front-rear direction and the up-down direction is defined as a left-right direction.

First, the motor 2 is described. As shown in FIG. 1, the motor 2 is housed in a rear lower portion of the body housing 12. Further, the motor 2 is arranged such that a rotation axis of an output shaft (not shown) extends in the left-right direction, orthogonal to the moving axis A1. In the present embodiment, a brushless DC motor is used as the motor 2. A pulley 21 is connected to the output shaft of the motor 2 and rotates together with the output shat. In the present embodiment, when the contact arm 125 of the nose part 14 is pressed against a workpiece and the switch of the contact arm 125 is turned on, or when the trigger 171 is depressed and the switch 172 is turned on, the controller 18 controls to supply current from the battery 100 to the motor 2 to start driving of the motor 2.

Figure 2:
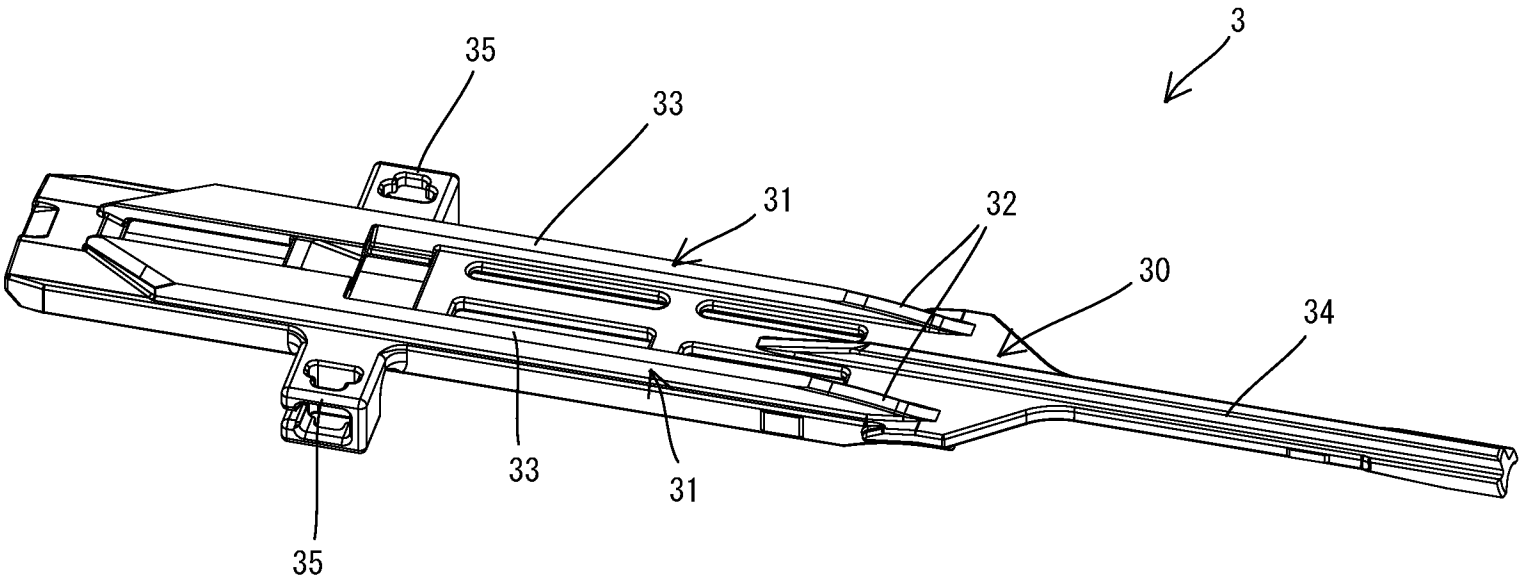
FIG. 2 is a perspective view of the driver.

The driver 3 is now described. As shown in FIGS. 1 and 2, the driver 3 is an elongate member and is arranged such that its longitudinal axis extends along the moving axis A1. The driver 3 has a bilaterally symmetrical shape, and includes a body 30, a striking part 34 and a pair of arms 35. The body 30 has a generally rectangular plate-like shape as a whole. The striking part 34 extends forward from a front end of the body 30 and has a smaller width than the body 30 in the left-right direction. The arms 35 protrude to the left and right from a rear portion of the body 30.

The body 30 is provided with a pair of roller-abutting parts 31 protruding upward from an upper surface of the body 30 and extending substantially in the front-rear direction along left and right edges of the body 30. The roller-abutting parts 31 are portions to be pressed by a roller 63. The roller-abutting part 31 is configured to have a thickness in the up-down direction (a height in the up-down direction from the upper surface of the body 30 to a protruding end surface (an upper surface of the protruding end)) which is not constant but changes toward the rear. More specifically, a front end portion of the roller-abutting part 31 is configured to have a thickness gradually increasing toward the rear at a certain ratio. In other words, an upper surface of the front end portion of the roller-abutting part 31 is a flat surface which extends obliquely upward toward the rear. The front end portion of the roller-abutting part 31 having such a thickness is hereinafter referred to as a cam part 32. A portion of the roller-abutting part 31 which extends rearward of the cam part 32 has a substantially constant thickness, and is hereinafter referred to as a straight part 33.

Figure 3:
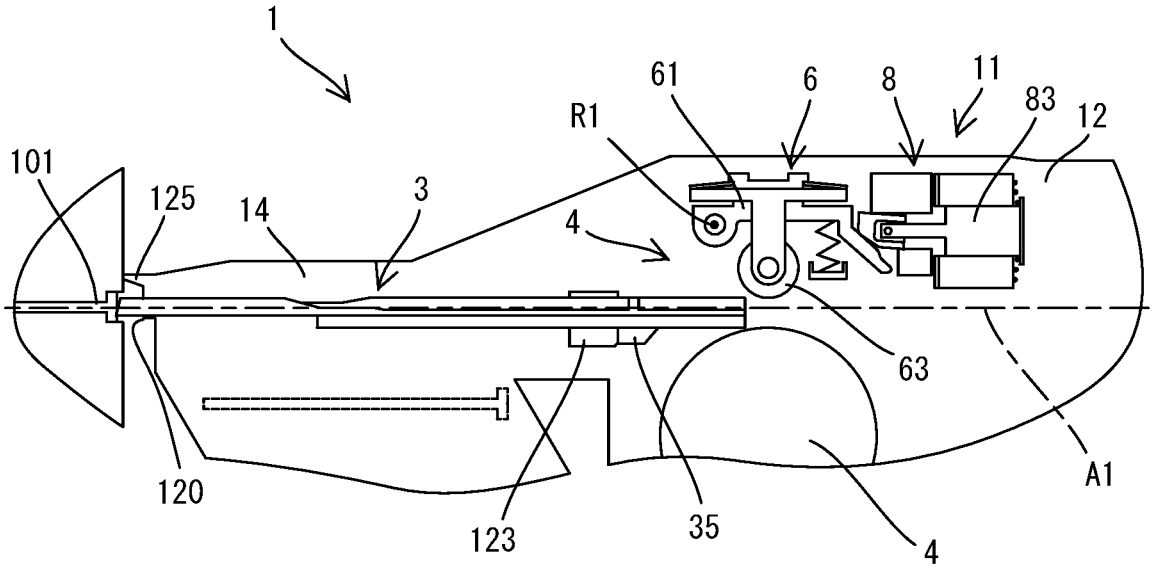
FIG. 3 is an explanatory drawing showing the inside of a tool body when the driver is located in a nail-driving position.

The driver 3 is held to be movable between an initial position and a nail-driving position along the moving axis A1 (that is, in the front-rear direction of the nailing machine 1 or in the longitudinal direction of the driver 3). The initial position is a position where the driver 3 is held in a state in which the driver-driving mechanism 4 is not operating (hereinafter referred to as an initial state). In the present embodiment, as shown in FIG. 1, the initial position of the driver 3 is set to a position where a rear end of the driver 3 abuts on a stopper 121, which is provided in a rear end portion of the body housing 12. The nail-driving position is a position where the driver 3 drives the nail 101 into a workpiece after being moved forward by the driver-driving mechanism 4. In the present embodiment, as shown in FIG. 3, the nail-driving position of the driver 3 is set to a position where a front end of the driver 3 slightly protrudes from the outlet 120. The nail-driving position is also a position where front ends of the pair of arms 35 abut from the rear on a pair of stoppers 123, which are provided within a front end portion of the body housing 12. With the above-described arrangement, in the present embodiment, the initial position and the nail-driving position can also be respectively referred to as a rearmost position and a foremost position in a movable range of the driver 3.

Although not described nor shown in detail, the arms 35 are connected to the return mechanism by connecting members. The return mechanism is configured to return the driver 3 to the initial position after the driver 3 is moved forward from the initial position. In the nailing machine 1 of the present embodiment, any known structure may be adopted as the return mechanism. For example, the return mechanism may be configured to return the driver 3 to the initial position via the connecting members along the moving axis A1 by an elastic force of a spring member (such as a compression coil spring and a torsion coil spring) after the driver 3 is moved forward from the initial position.

The driver-driving mechanism 4 is now described. In the present embodiment, as shown in FIG. 1, the driver-driving mechanism 4 includes a flywheel 5, a pressing mechanism 6 and a solenoid 8. The structures of these components are now described in detail in this order.

Firstly, the flywheel 5 is described. As shown in FIG. 1, the flywheel 5 has a cylindrical shape, and is rotatably supported in front of the motor 2 within the body housing 12. The flywheel 5 is configured to be rotationally driven by the motor 2. A rotation axis of the flywheel 5 extends in parallel to a rotation axis of the motor 2 and in a direction (the left-right direction) which is orthogonal to the moving axis A1 of the driver 3. A pulley 51 is connected to a support shaft of the flywheel 5. The pulley 51 rotates together with the support shaft and the flywheel 5. A belt 25 is looped over the pulleys 21 and 51. When the motor 2 is driven, rotation of the output shaft of the motor 2 is transmitted to the flywheel 5 via the belt 25, and the flywheel 5 rotates counterclockwise as viewed in FIG. 1.

Figure 4:
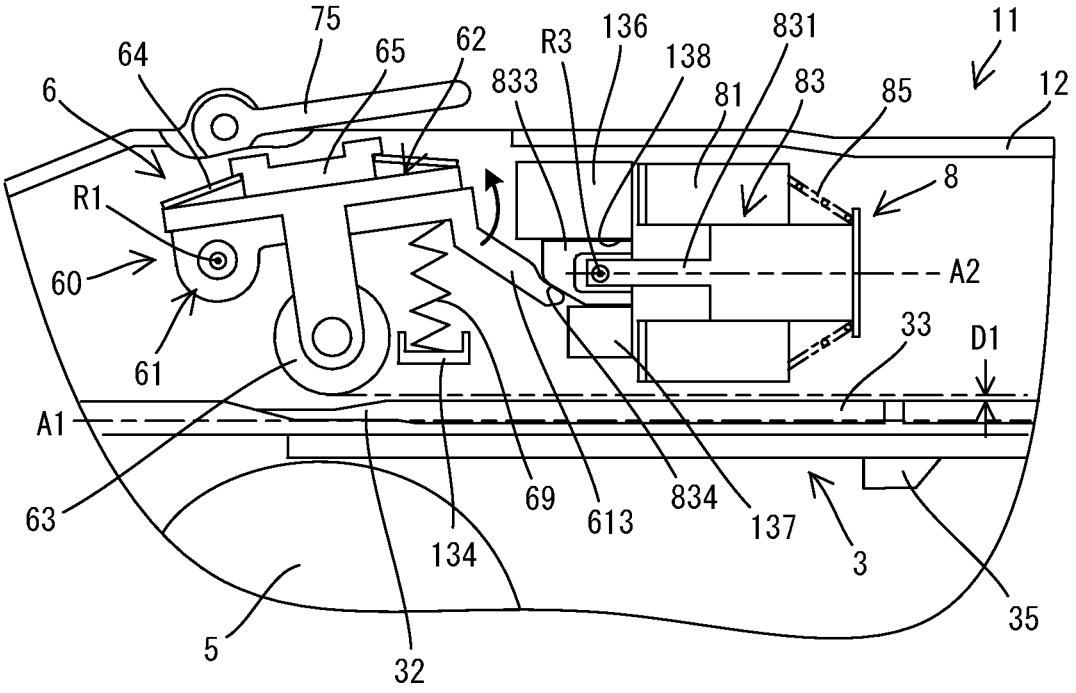
FIG. 4 is a partial, enlarged view of FIG. 1.

The pressing mechanism 6 is now described. As shown in FIG. 1, the pressing mechanism 6 is disposed on the side opposite to the flywheel 5 across the driver 3 in a facing direction (the up-down direction) in which the flywheel 5 and the driver 3 face each other. Specifically, the pressing mechanism 6 is disposed to face the driver 3 from above. The pressing mechanism 6 is configured to press the driver 3 located in the initial position, downward against the flywheel 5, to thereby enable transmission of the rotational energy from the flywheel 5 to the driver 3. As shown in FIG. 4, in the present embodiment, the pressing mechanism 6 includes a pressing unit 60 and a biasing spring 69.

Figure 5:
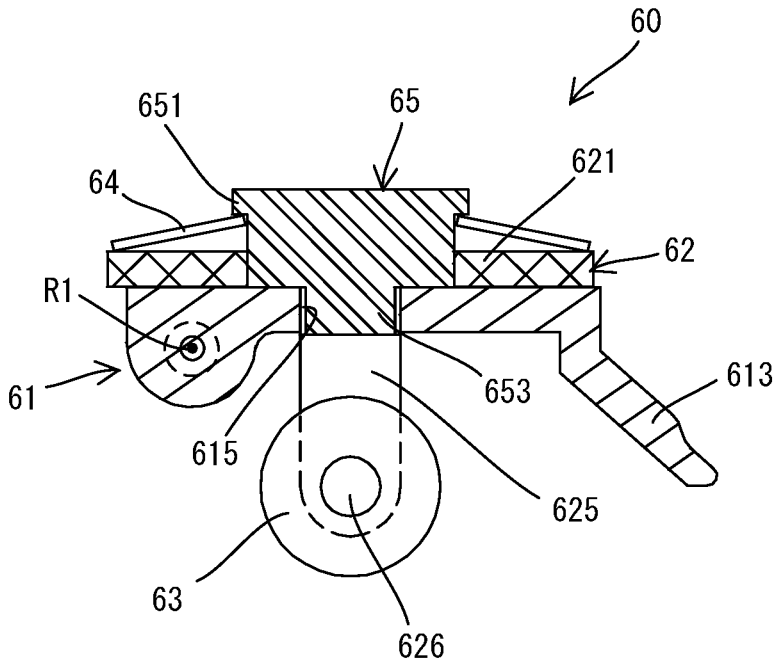
FIG. 5 is a sectional view of a pressing unit.

The pressing unit 60 is now described. As shown in FIGS. 4 and 5, the pressing unit 60 includes a holder base 61, a roller holder 62, a roller 63, a biasing spring 64 and a fastening member 65.

Figure 6:
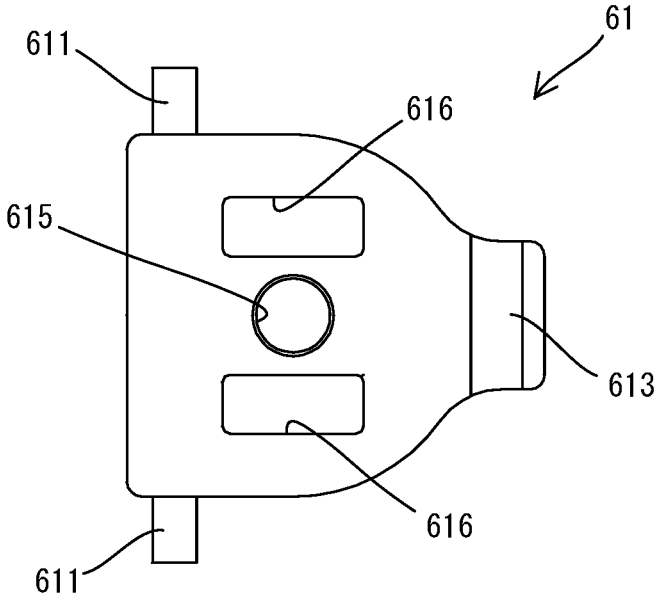
FIG. 6 is a top view of a holder base.

The holder base 61 is a member which is turnably supported by the body housing 12, and configured to hold the roller holder 62 such that the roller holder 62 is movable relative to the holder base 61. Specifically, as shown in FIGS. 5 and 6, the holder base 61 is generally home-base shaped as a whole when viewed from above. The holder base 61 is arranged such that a protruding corner portion of the home-base shaped holder base 61 is located at the rear end. A pair of circular columnar shafts 611 are protruding to the left and right on a front end portion of the holder base 61. The shafts 611 are coaxially arranged on an axis extending in the left-right direction. The rear end portion (the protruding corner portion) of the holder base 61 is inclined obliquely downward toward the rear when viewed from the right or left. This portion forms a press-receiving part 613 to be pressed by a plunger 83. Further, a threaded hole 615 is formed in the center of the holder base 61, and a pair of through holes 616 are formed on opposite sides of the threaded hole 615.

The roller holder 62 is a member which is configured to rotatably support the roller 63. The roller holder 62 is held by the holder base 61 so as to be movable generally in the up-down direction relative to the holder base 61. Specifically, as shown in FIG. 5, the roller holder 62 includes an annular spring-receiving part 621 and a pair of left and right legs 625 protruding downward from the spring-receiving part 621. The roller holder 62 is engaged with the holder base 61 with the spring-receiving part 621 disposed on an upper side of the holder base 61 and with the legs 625 inserted through the through holes 616 (see FIG. 6).

The roller 63 is rotatably supported by the roller holder 62 via a shaft 626 which is supported by lower end portions of the legs 625. A rotation axis of the roller 63 extends in the left-right direction. The length of the roller 63 in the left-right direction is set to be longer than the distance between the pair of roller-abutting parts 31 (see FIG. 2) of the driver 3 in the left-right direction. The roller 63 can thus abut on both of the roller-abutting parts 31.

The biasing spring 64 is disposed on an upper side of the spring-receiving part 621 of the roller holder 62. In the present embodiment, a disc spring is used for the biasing spring 64. The biasing spring 64 has an inner diameter substantially equal to the inner diameter of the spring-receiving part 621, and an outer diameter slightly smaller than the outer diameter of the spring-receiving part 621. Further, the biasing spring 64 has a nonlinear characteristic. Specifically, an amount of displacement of the biasing spring 64 is not proportional to a load (an elastic force, a spring force, a biasing force) of the biasing spring 64. More specifically, the biasing spring (disc spring) 64 has a nonlinear characteristic that a rate of increase of a load relative to increase of the amount of displacement decreases as the amount of displacement increases.

The fastening member 65 has a diameter substantially equal to the inner diameter of the spring-receiving part 621 of the roller holder 62 and the biasing spring 64. A flange part 651 protrudes radially outward from an upper end portion of the fastening member 65. A male thread part 653 protrudes downward from the center of a lower end portion of the fastening member 65. The fastening member 65 is inserted through the biasing spring 64 and the spring-receiving part 621 with the flange part 651 placed on the biasing spring 64, and the male thread part 653 is threadedly engaged with the thread hole 615 of the holder base 61. Thus, the fastening member 65 is fixed to the holder base 61 with the roller holder 62 and the biasing spring 64 therebetween, so that the pressing unit 60 is formed into a single assembly.

In the present embodiment, the biasing spring 64 is disposed between the spring-receiving part 621 of the roller holder 62 and the flange part 651 of the fastening member 65 in a slightly compressed state. Thus, the roller holder 62 is biased downward relative to the holder base 61. Therefore, in a state (initial state) in which an external force of pushing the roller holder 62 upward via the roller 63 is not applied thereto, the roller holder 62 is held with a lower surface of the spring-receiving part 621 abutted on an upper surface of the holder base 61. On the other hand, when the roller holder 62 is pushed upward via the roller 63, the roller holder 62 and the roller 63 move upward relative to the holder base 61 while compressing the biasing spring 64.

The pressing unit 61 having the above-described structure is turnably supported relative to the body housing 12 via a pair of support blocks 71. A support structure of supporting the pressing unit 61 is now described.

Figure 7:
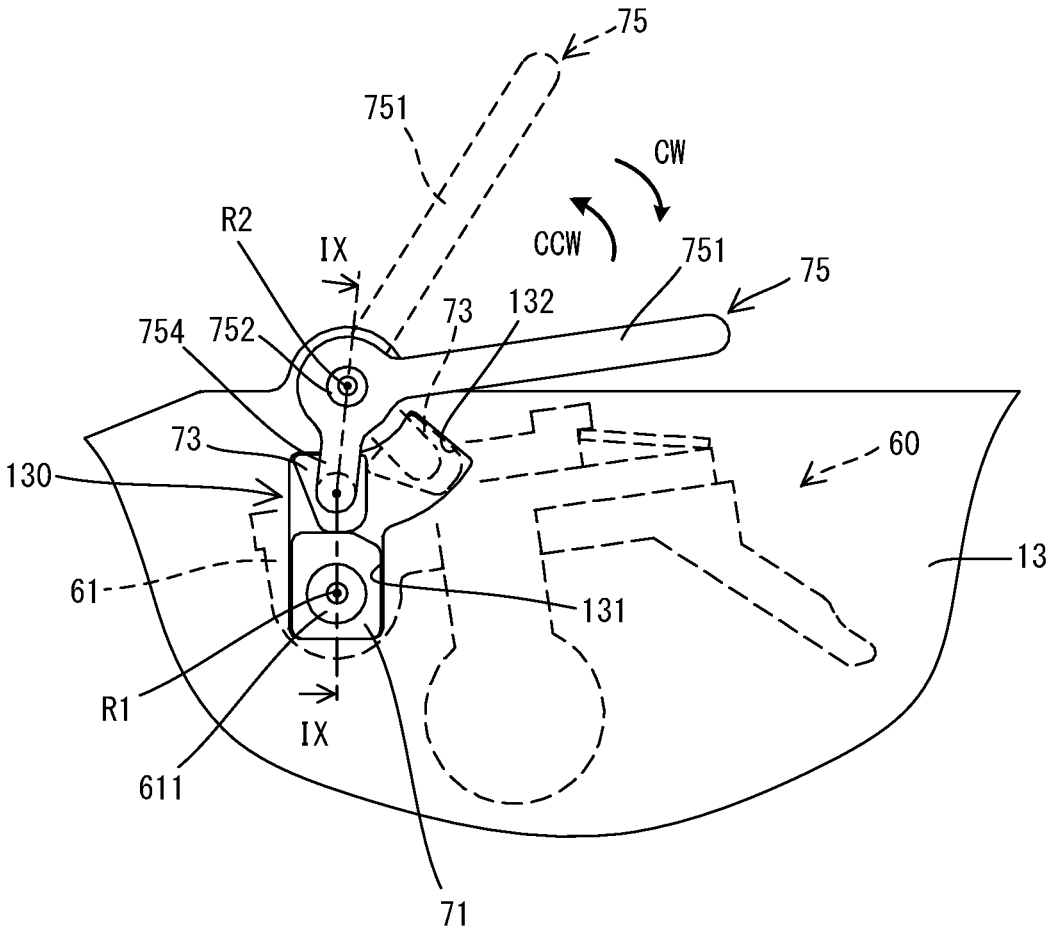
FIG. 7 is an explanatory drawing of the pressing unit and its support structure.
Figure 8:
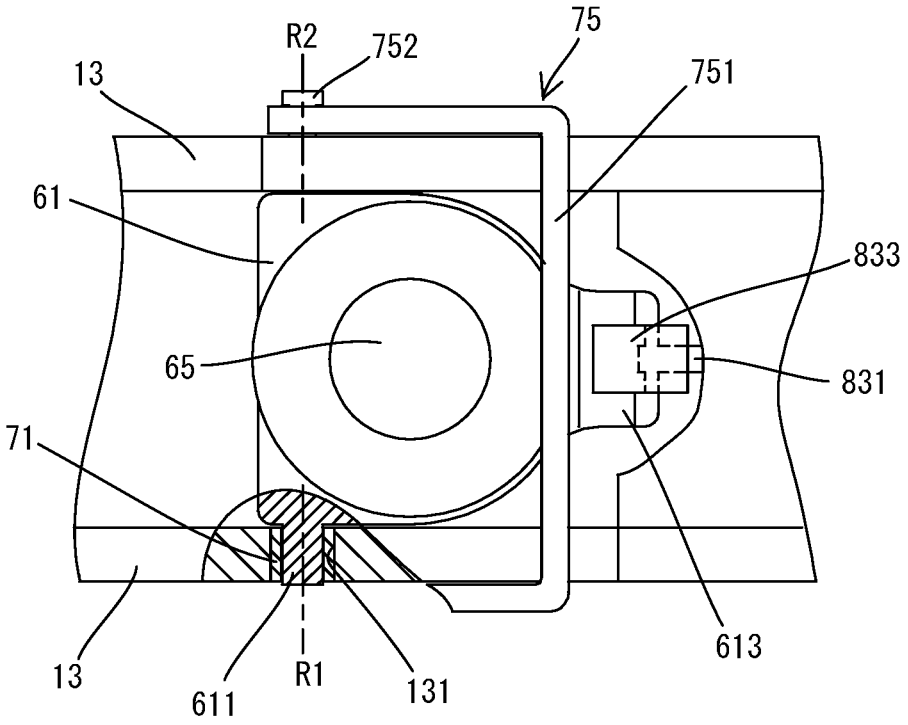
FIG. 8 is a view (in partial section) of the pressing unit and its support structure as viewed from above.
Figure 9:
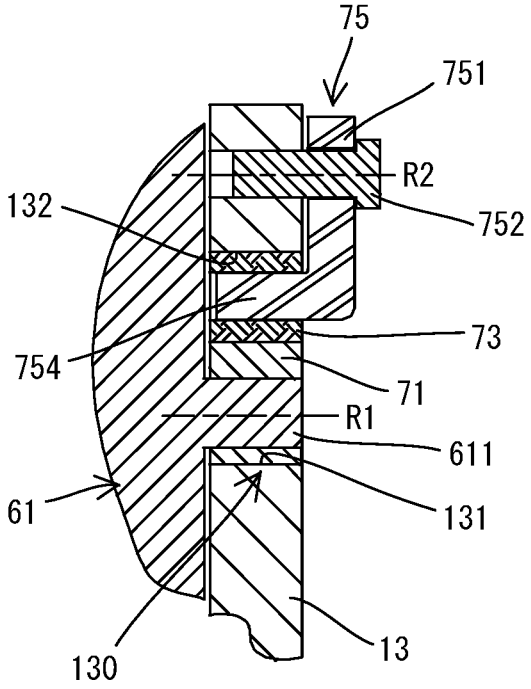
FIG. 9 is a sectional view taken along line IX-IX in FIG. 7.

As shown in FIGS. 7 to 9, a pair of left and right support walls 13 are provided within the body housing 12 (see FIG. 1). The support walls 13 are plate-like portions arranged opposite to each other in the left-right direction and integrally connected and fixed to the body housing 12. Each of the support walls 13 has a guide groove 130. The guide groove 130 is a through hole extending through the support wall 13 in the left-right direction. The guide groove 130 includes a first portion 131 and a second portion 132. The first portion 131 has a generally rectangular shape in a side view and extends in the up-down direction. The second portion 132 has a circular arc shape in a side view and extends continuously from an upper end portion of the first portion 131. The second portion 132 extends obliquely upward and rearward from the same position as the position of the first portion 131 in the front-rear direction.

Each of the support blocks 71 is a generally rectangular parallelepiped member. The support block 71 is fitted in the first portion 131 of the guide groove 130. The support block 71 has a through hole extending in the left-right direction. The left and right shafts 611 of the holder base 61 are rotatably inserted through the through holes of the pair of left and right support blocks 71, respectively. Thus, the pressing unit 60 is supported by the support walls 13 (and thus the body housing 12) via the support blocks 71 so as to be rotatable around a rotation axis R1 extending in the left-right direction. Further, an upper rear end portion of the support block 71 has an inclined surface inclined downward toward the rear.

As shown in FIG. 4, the biasing spring 69 is configured to bias the pressing unit 60 (specifically, the holder base 61). The biasing member 69 is disposed under the holder base 61 in the vicinity of the press-receiving part 613. In the present embodiment, the biasing spring 69 is a compression coil spring and is arranged to extend in the up-down direction. A lower end of the biasing spring 69 is held in abutment with a spring-receiving part 134 which is fixed to the support walls 13 (see FIG. 7), and an upper end of the biasing spring 69 is held in abutment with a lower surface of the holder base 61. The plunger 83 of the solenoid 8 is always held in abutment with an upper surface (inclined surface) of the press-receiving part 613 of the holder base 61 and restricts upward movement of the press-receiving part 613, which will be described in detail later. Thus, the biasing spring 69 is always compressed to bias the pressing unit 60 (the holder base 61) in such a direction that the rear end portion (the press-receiving part 613) of the pressing unit 60 is moved upward around the rotation axis R1 provided in the front end portion of the pressing unit 60 (in the counterclockwise direction as viewed from the left or the direction of an arrow in FIG. 4).

Further, in the present embodiment, as shown in FIG. 7, the pressing unit 60 is also supported to be movable in the up-down direction relative to the body housing 12 via the support blocks 71. More specifically, each of the support blocks 71 is configured to be slidable in the up-down direction within the guide groove 130, so that the pressing unit 60 is also movable in the up-down direction along with the movement of the support blocks 71 in the up-down direction. Each of the support blocks 71 is normally held in a specified position by a locking block 73 which is fitted in the guide groove 130, while being allowed to move upward when the locking block 73 is moved, which is described in detail below.

As shown in FIGS. 7 to 9, the locking block 73 is a generally rectangular parallelepiped member. The locking block 73 has an arcuately curved lower end surface and a through hole extending in the left-right direction. The locking block 73 is configured to move in an arc between a lower front end portion and an upper rear end portion of the second portion 132 of the guide groove 130 according to an operation of a lever 75 by a user.

The lever 75 has a generally U-shaped operation part 751. Both end portions of the operation part 751 are respectively supported by the left and right support walls 13 via support pins 752 so as to be rotatable around a rotation axis R2 extending in the left-right direction. A pair of arms 754 respectively protrude from the both end portions of the operation part 751. A distal end portion of each arm 754 protrudes toward the inside of the support wall 13 and rotatably inserted into the through hole of the locking block 73.

As shown in a solid line in FIG. 7, when the lever 75 is turned rearward (in the clockwise direction as viewed from the left or the direction of arrow CW in FIG. 7) to a position where the operation part 751 is closest to an upper end of the support wall 13, each of the arms 754 extends generally downward, and the locking block 73 connected to the distal end portion of the arm 754 is located within the lower front end portion of the second portion 132. At this time, the lower end surface of the locking block 73 abuts on an upper end surface of the support block 71, thus preventing the support block 71 from moving upward from a lowermost position within the first portion 131. Thus, the support block 71 is locked in the lowermost position by the locking block 73. Therefore, respective positions of the lever 75 and the locking block 73 when the operation part 751 is located closest to the upper end of the support wall 13 are hereinafter also referred to as lock positions. During the nailing operation of the nailing machine 1, the lever 75 and the locking blocks 73 are located in their respective lock positions and the support blocks 71 are located in their lowermost positions. The lowermost position of the support block 71 is hereinafter also referred to as a normal position.

As shown in a dotted line in FIG. 7, when the lever 75 is turned from the lock position in such a direction that the operation part 751 is moved upward away from the support wall 13 (in the counterclockwise direction as viewed from the left or the direction of arrow CCW in FIG. 7), each of the locking blocks 73 moves upward and rearward within the second portion 132, from the lock position in the lower front end portion of the second portion 132. Thus, the lock by the locking blocks 73 is released, so that the support blocks 71 are allowed to move upward from their normal positions (lowermost positions). Therefore, respective positions of the lever 75 and the locking block 73 when the operation part 751 is in an uppermost position and the locking block 73 is located within the upper rear end portion of the second portion 132 are hereinafter also referred to as unlock positions. The lever 75 and the locking blocks 73 can be moved to their respective unlock positions, for example, when a trouble such as jamming of the driver 3 occurs, which will be described in detail later.

The solenoid 8 is now described with reference to FIG. 4. The solenoid 8 is a well-known electric component which is configured to convert electrical energy into mechanical energy of linear motion by utilizing an electric field generated by energization of a coil 81 of the solenoid 8. The solenoid 8 may also be referred to as a solenoid actuator or a linear solenoid. In the present embodiment, the solenoid 8 is used to turn the holder base 61 against the biasing force of the biasing spring 69 when activated.

As shown in FIG. 4, the solenoid 8 includes the coil 81 housed within a cylindrical case (not shown), the plunger 83 which is linearly movable in an axial direction of the coil 81, and a return spring 85. The solenoid 8 is supported by the support walls 13 (see FIG. 7) such that a moving axis A2 of the plunger 83 extends in parallel to the moving axis A1 of the driver 3 (that is, in the front-rear direction).

The plunger 83 includes a rod part 831 and a turnable part 833. The rod part 831 is a rod-like portion protruding forward from the coil 81 along the moving axis A2. The turnable part 833 is connected to a front end portion of the rod part 831 via a connecting pin so as to be turnable around a rotation axis R3 extending in the left-right direction. The turnable part 833 has a generally rectangular parallelepiped shape, but a lower surface of a front end portion of the turnable part 833 forms an inclined surface 834 which is inclined upward toward the front. The inclined surface 834 is at least partially held in abutment with the upper surface (inclined surface) of the press-receiving part 613 of the holder base 61. Further, an upper guide 136 and a lower guide 137 are disposed in front of the coil 81 and respectively on upper and lower sides of the turnable part 833, and fixed to the support walls 13. A passage 138 for guiding movement of the turnable part 833 is formed between the upper guide 136 and the lower guide 137 and extends linearly in the front-rear direction. The height of the passage 138 in the up-down direction is set to be slightly larger than the height of the turnable part 833. Further, a front end of the upper guide 136 is located forward of a front end of the lower guide 137 in the front-rear direction.

The return spring 85 is disposed between a rear end surface of the case of the coil 81 and a flange part formed on a rear end of the plunger 83. The return spring 85 always biases the plunger 83 rearward relative to the coil 81. In the present embodiment, a conical coil spring is used for the return spring 85.

With the above-described structure, in an OFF state in which the solenoid 8 is not activated (that is, when the coil 81 is not energized), the plunger 83 is held in a rearmost position within its movable range (hereinafter also referred to as an initial position) by the biasing force of the return spring 85. As shown in FIG. 4, when the plunger 83 is located in the rearmost position, a front end of the turnable part 833 is located rearward of the front end of the upper guide 136, and a rear end of the turnable part 833 is located generally at the same position as rear ends of the upper guide 136 and the lower guide 137. Thus, generally the whole of the turnable part 833 is located within the passage 138. Further, the inclined surface 834 of the front end portion of the turnable part 833 abuts on an upper surface of the press-receiving part 613 of the holder base 51, and locks the holder base 61 which is biased to turn by the biasing spring 69. At this time, the press-receiving part 613 is located in an uppermost position within its movable range.

Figure 10:
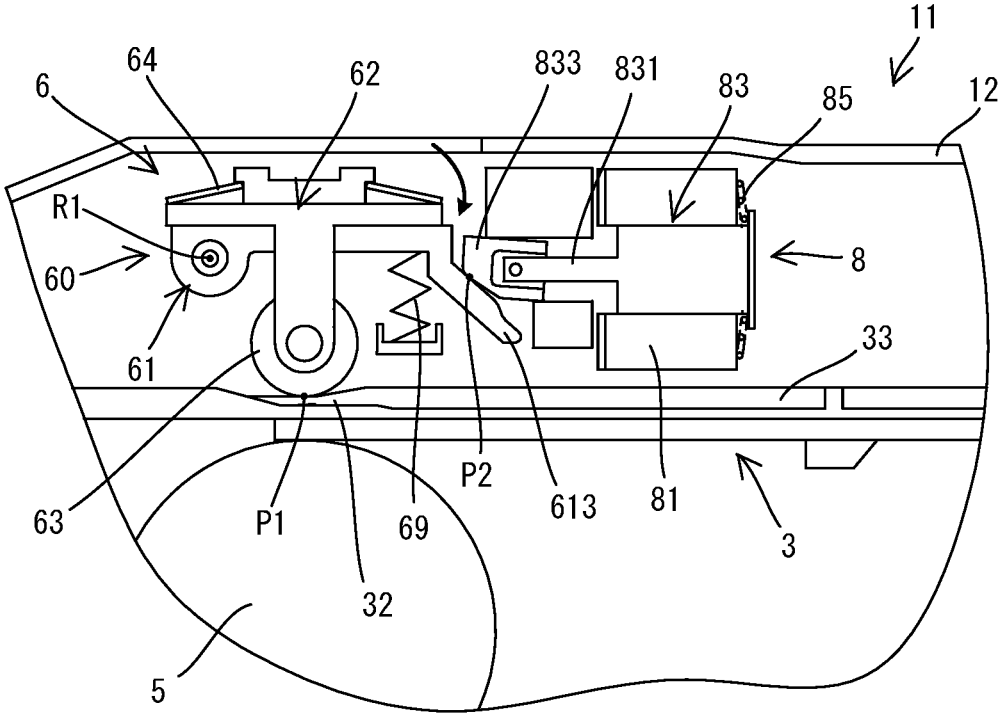
FIG. 10 is an explanatory drawing showing a state in which the holder base is located in a pressing position.

When the solenoid 8 is activated and switched to an ON state (that is, when the coil 81 is energized), as shown in FIG. 10, the plunger 83 moves forward from the rearmost position against the biasing force of the return spring 85. Along with the forward movement of the plunger 83, the turnable part 833 presses the press-receiving part 613 downward via the inclined surface 834 while moving forward. Therefore, the holder base 61 turns against the biasing force of the biasing spring 69 in such a direction that the press-receiving part 613 moves downward (in the clockwise direction as viewed from the left or the direction of an arrow in FIG. 10). Thus, when the solenoid 8 is switched from the OFF state to the ON state, the plunger 553 moves forward from the rearmost position (initial position), pushes the press-receiving part 613 downward from the uppermost position and thereby turns the holder base 61.

Operation of the nailing machine 1 during a nailing operation is now described.

As described above, a nailing operation is performed with the lever 75 and the locking blocks 73 located in their lock positions and with the support blocks 71 held in their normal positions as shown in FIG. 7. As shown in FIGS. 1 and 4, when the driver-driving mechanism 4 is in the initial state, the driver 3 is located in the initial position (rearmost position). The plunger 83 is in its initial position (rearmost position) and the holder base 61 is held with the press-receiving part 613 located in the uppermost position. At this time, the lower end of the roller 63 is located at a distance D1 apart upward from an uppermost end of the roller-abutting parts 31 of the driver 3. In other words, the roller 63 is held in a position apart from the driver 3 (where the roller 63 cannot come into contact with the driver 3). A position of the holder base 61 in the initial state (that is, when the support blocks 71 are in the normal positions and the press-receiving part 613 is located in the uppermost position) is hereinafter referred to as a separate position. In the initial state, the roller 63 is located right above the cam parts 32 of the roller-abutting parts 31 and faces an upper surfaces of the cam parts 32.

When the switch (not shown) of the contact arm 125 or the switch 172 of the trigger 171 is switched to the ON state, the controller 18 controls to supply current from the battery 100 to the motor 2 to start driving of the motor 2. At this time, the flywheel 5 also starts rotating. In this stage, however, the flywheel 5 is not in contact with the driver 3, so that the rotational energy of the flywheel 5 is not transmitted to the driver 3. Therefore, even if the flywheel 5 rotates, the driver 3 does not move.

Thereafter, when the switch (not shown) of the contact arm 125 and the switch 172 of the trigger 171 are both placed in the ON state, the controller 18 activates the solenoid 8 by energizing the coil 81. Then, as shown in FIG. 10, the plunger 83 moves forward from the initial position and turns the holder base 61. Along with this movement, the roller 63 moves downward and pushes the driver 3 downward in abutment with the upper surfaces of the cam parts 32. The roller 63 then presses the driver 3 against the flywheel 5 to cause the driver 3 to be frictionally engaged with the flywheel 5. Here, the "frictionally engaged" state refers to a state (including a sliding state) that the two members are engaged with each other by frictional force. The frictional engagement between the driver 3 and the flywheel 5 enables transmission of the rotational energy from the flywheel 5 to the driver 3. The driver 3 receives the rotational energy from the flywheel 5 and starts moving forward at high speed.

A position of the holder base 61 when the support blocks 71 are in the normal positions and the roller 63 presses the driver 3 to frictionally engage the driver 3 with the flywheel 5 (to enable transmission of the rotational energy) is hereinafter referred to as a pressing position. Further, a position of the plunger 83 at this time is referred to as an actuation position. When the holder base 61 is located in the pressing position, the distance between the rotation axis R1 and a contact position (point P1 in FIG. 10) between the roller 63 and the driver 3 is shorter than the distance between the rotation axis R1 and a contact position (point P2 in FIG. 10) between the turnable part 833 and the press-receiving part 613. With this structure, when the roller 63 presses the driver 3, the force of pressing back the plunger 83 toward the initial position can be made relatively small.

Figure 11:
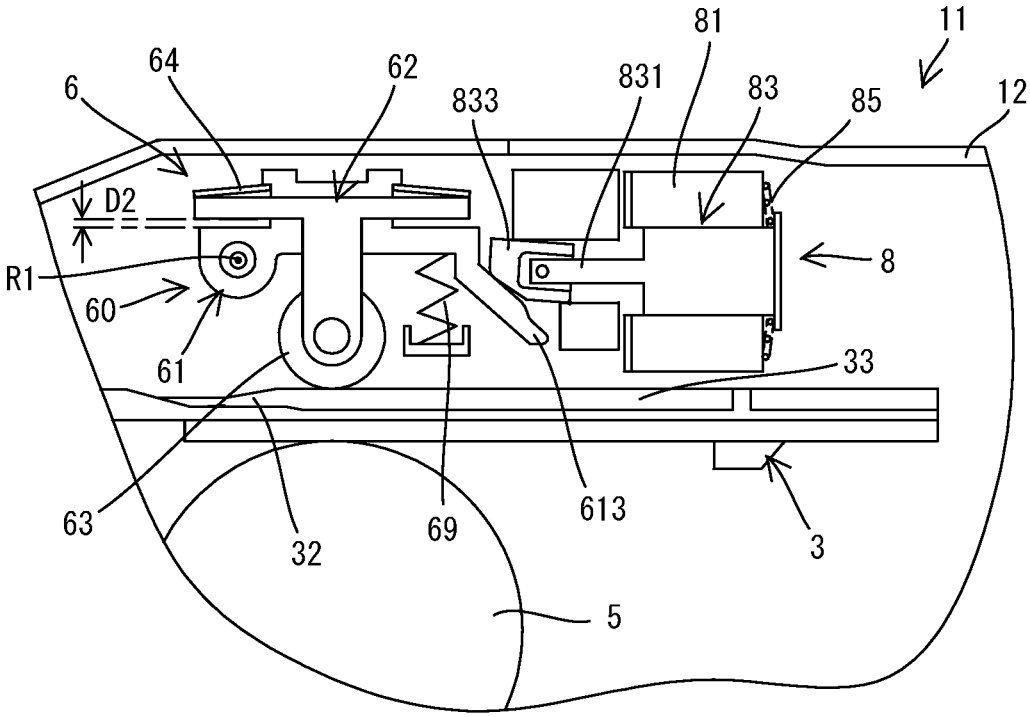
FIG. 11 is an explanatory drawing showing a state in which a roller holder is pushed up by the driver.

As the driver 3 moves forward, the cam parts 32, which have the thickness gradually increasing toward the rear, push the roller 63 and the roller holder 62 upward relative to the holder base 61. Thus, the biasing spring 64 is compressed and displaced, so that its elastic force is increased. Therefore, the roller 63 biased by the biasing spring 64 strongly presses the driver 3 against the flywheel 5, so that the frictional engagement between the driver 3 and the flywheel 5 gets firmer. As shown in FIG. 11, when the roller 63 passes a rear end of the cam parts 32 and reaches the straight parts 33, the roller 63 and the roller holder 62 are pushed up by a distance D2 from the position where the roller 63 abuts on the cam parts 32 and frictionally engages the driver 3 with the flywheel 5. The load of the biasing spring 64 reaches an upper limit and is kept constant. The driver 3 moves forward while being strongly pressed against the flywheel 5 by the roller 63, and strikes the nail 101. FIG. 11 shows a state in which the driver 3 is located in a striking position where the driver 3 strikes the nail 101 (see FIG. 1) with a tip of the striking part 34.

In the present embodiment, as described above, the biasing spring 64 has a nonlinear characteristic that the rate of increase of the load relative to increase of the amount of displacement decreases as the amount of displacement increases. Therefore, in the process that the roller 63 moves rearward relative to the cam parts 32 along with the movement of the driver 3, the rate of increase of the load of the biasing spring 64 varies. Specifically, the load of the biasing spring 64 rapidly increases immediately after the driver 3 is pressed against the flywheel 5 and frictionally engaged therewith and the roller 63 starts moving on the cam parts 32, while it gently increases as the roller 63 approaches the rear ends of the cam parts 23. Utilizing the biasing spring 64 having such a characteristic can establish firm frictional engagement between the driver 3 and the flywheel 5 immediately after the driver 3 starts moving, and can gently shift to a state in which the load of the biasing spring 64 is maximum.

Figure 12:
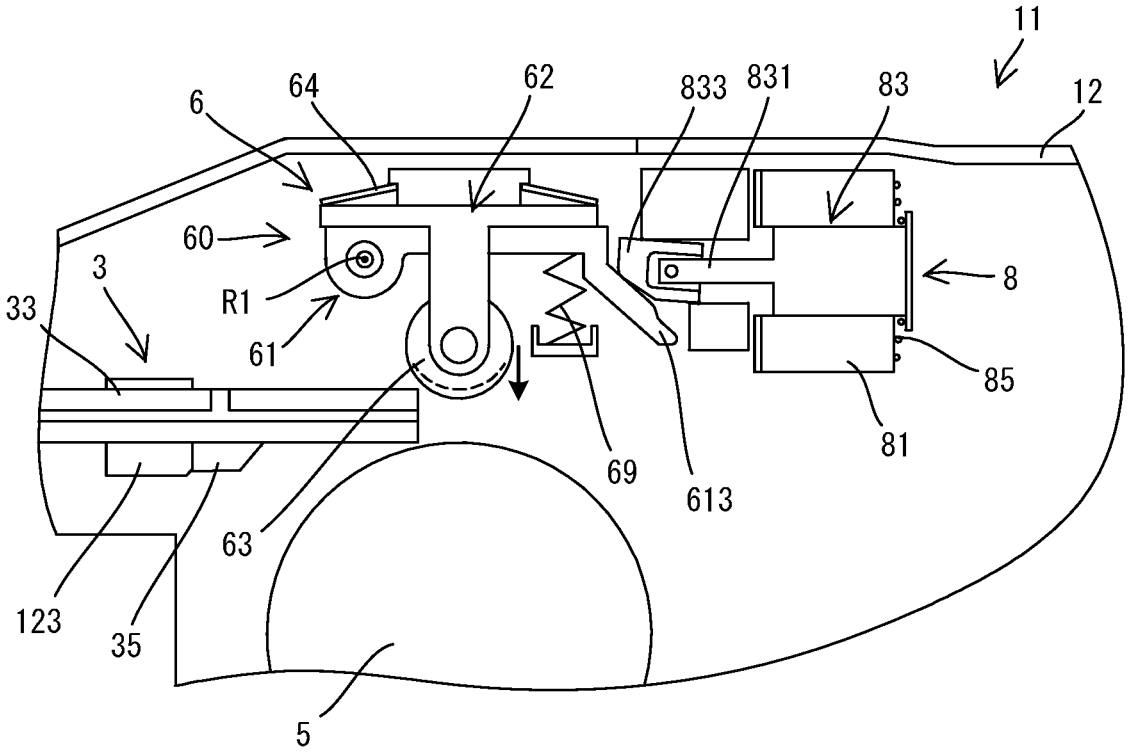
FIG. 12 is an explanatory drawing for illustrating operation of a pressing mechanism after the driver reaches the nail-driving position.

Then, the driver 3 further moves to the nail-driving position shown in FIG. 3 and drives the nail 101 into the workpiece. The driver 3 stops moving when the front ends of the arms 35 of the driver 3 abut on the stoppers 123 from the rear. When the driver 3 reaches the nail-driving position, the roller 63 and the roller holder 62 are no longer pushed up by the roller-abutting parts 31. Therefore, the roller holder 62 biased by the biasing spring 64 moves downward relative to the holder base 61 as shown by an arrow in FIG. 12, and returns to the position where the lower surface of the spring-receiving part 621 abuts on the upper surface of the holder base 61.

Figure 13:
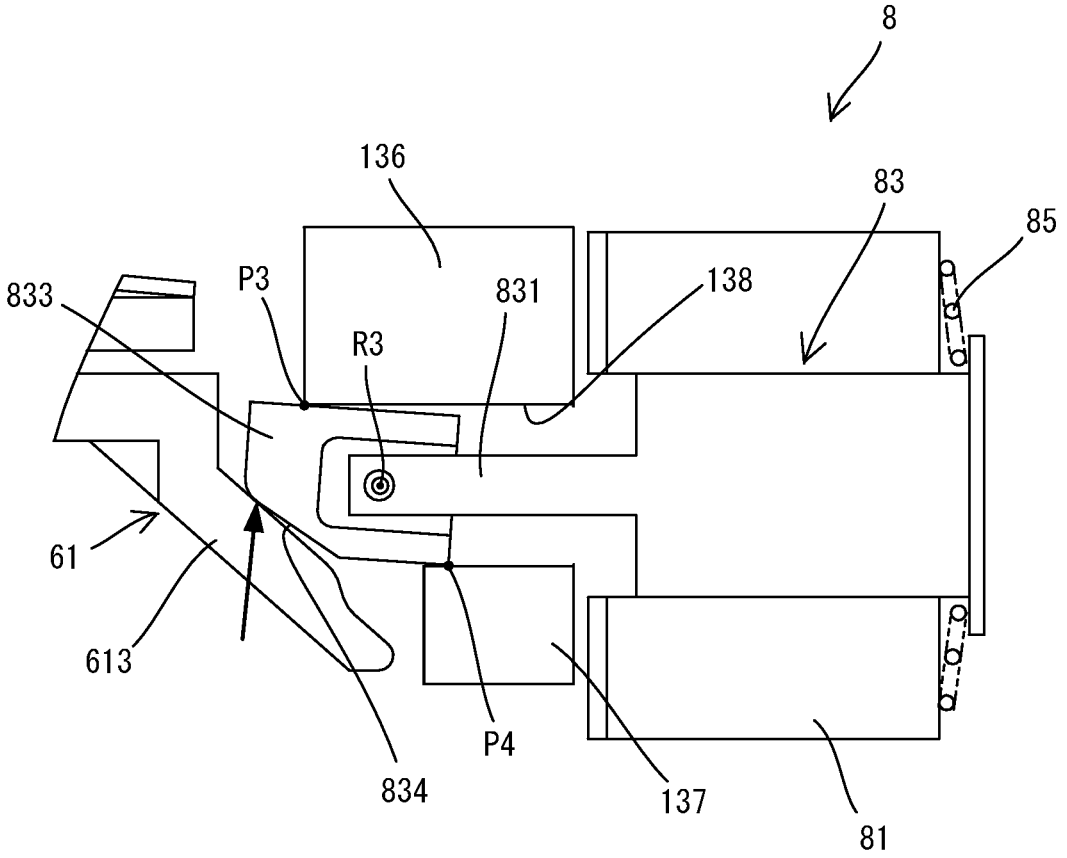
FIG. 13 is an explanatory drawing for illustrating operation of a turnable part of a plunger.

As shown in FIG. 13, when the solenoid 8 is activated and the holder base 61 is placed in the pressing position, the front end of the turnable part 833 is located forward of the front end of the upper guide 136 (that is, located outside the passage 138), and the rear end of the turnable part 833 is located rearward of the front end of the lower guide 137 (that is, located inside the passage 138). As described above, the holder base 61 is biased to turn around the rotation axis R1 in the counterclockwise direction as viewed from the left. The turnable part 833, which is held in abutment with the press-receiving part 613, is subjected to this biasing force via the holder base 61. This biasing force acts in a tangential direction of a circle around the rotation axis R1 as viewed from the left (in the direction of an arrow in FIG. 13). Therefore, the turnable part 833 turns around the rotation axis R3 in the clockwise direction as viewed from the left and held in a position where a lower rear end of the turnable part 833 abuts on the lower guide 137 and an upper surface of the turnable part 833 abuts on a lower front end of the upper guide 136. An upper front end of the turnable part 833 is located forward and upward of an upper front end of the passage 138. Therefore, when the plunger 83 attempts to move rearward, resistance is generated at a contact position (point P3 in FIG. 13) between the turnable part 833 and the upper guide 136 and a contact position (point P4 in FIG. 13) between the turnable part 833 and the lower guide 137.

Thereafter, when the roller 63 is pushed up by the cam parts 32 along with the forward movement of the driver 3, the biasing spring 64 is compressed and a further biasing force of the biasing spring 64 is applied to the holder base 61 in a direction to push the fastening member 65 upward. The turnable part 833 is subjected to this biasing force via the holder base 61. In the present embodiment, the turnable part 833 is configured such that the biasing force of the return spring 85 for the plunger 83 exceeds the resistance of the turnable part 833 when the biasing force of the biasing spring 64 which is generated by the roller 63 being pushed upward is not applied to the holder base 61, while the resistance of the turnable part 833 exceeds the biasing force of the return spring 85 when such biasing force of the biasing spring 64 is applied to the holder base 61. In other words, the turnable part 833 is configured to prevent the plunger 83 from returning to the initial position while the roller 63 is pushed upward, even if the solenoid 8 is turned to the OFF state. Thus, the holder base 61 is also prevented from returning from the pressing position to the separate position.

In the present embodiment, the controller 18 is configured to stop energization of the coil 81 when a specified time elapses which is required for the driver 3 to reach the striking position after start of energization of the coil 81. As described above, however, while the driver 3 moves from the striking position to the nail-driving position, the plunger 83 is held in the actuation position by the resistance of the turnable part 833 and holds the holder base 61 in the pressing position. Therefore, the possibility of defective nail driving can be reduced which might otherwise be caused by such a failure that it becomes impossible to press the driver 3 or the frictional engagement becomes unstable due to insufficient pressing of the driver 3, before completing driving of the nail 101. Further, the need to closely control the timing to stop energization of the coil 81 can be eliminated.

Figure 14:
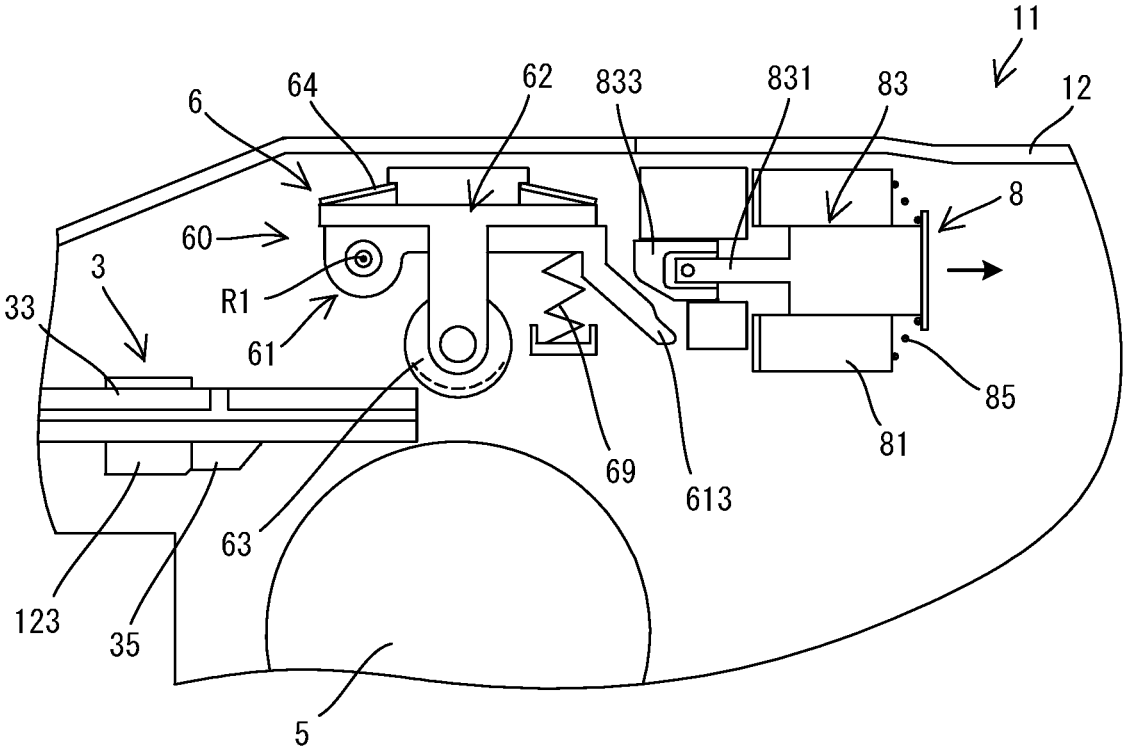
FIG. 14 is an explanatory drawing for illustrating operation of a solenoid after the driver reaches the nail-driving position.
Figure 15:
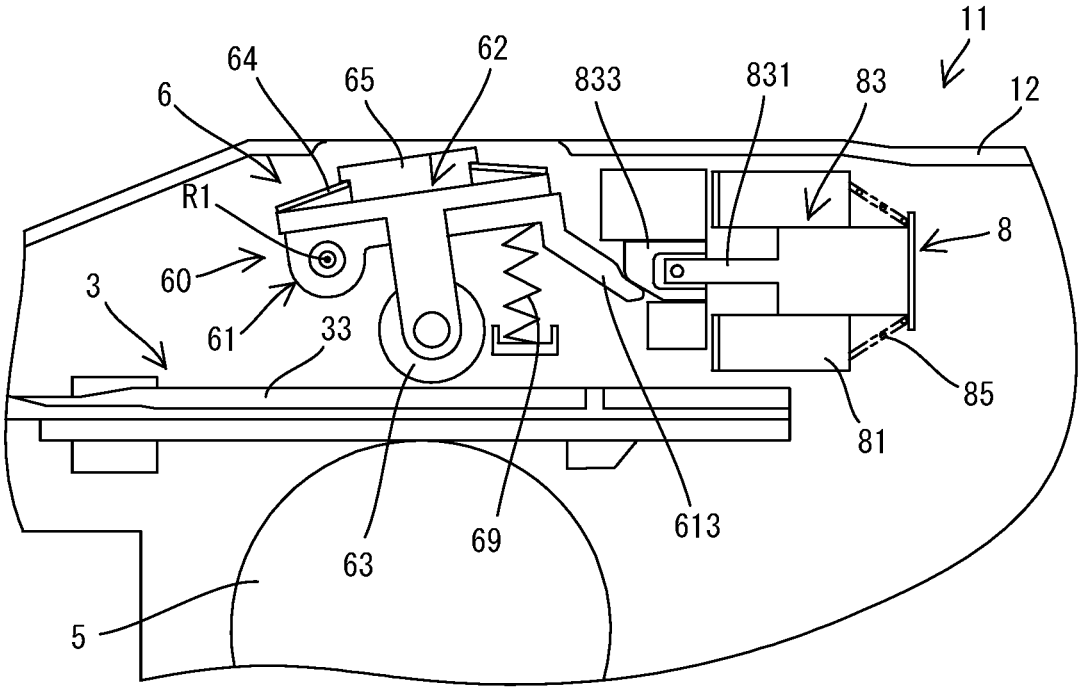
FIG. 15 is an explanatory drawing showing the pressing mechanism and the solenoid when the driver is returned to the initial position.

When the driver 3 reaches the striking position and the roller holder 62 returns to the lowermost position, the plunger 83 moves rearward from the actuation position toward the initial position by the biasing force of the return spring 85, as shown by an arrow in FIG. 14. Further, when the plunger 83 returns to the initial position, as shown in FIG. 15, the pressing unit 60 biased by the biasing spring 69 returns to the separate position (where the lower end of the roller 63 is located apart upward from the uppermost end of the driver 3). Therefore, the driver 3 can be returned to the initial position by the return mechanism without interfering with the roller 63. It is noted that the driver 3 may rebound forward by impact of collision between the rear end of the driver 3 and the stopper 121. Even in such a case, since the holder base 61 is back in the separate position, the driver 3 can be prevented from being pressed by the roller 63 and frictionally engaged with the flywheel 5, and thus from unintentionally driving out a nail.

Figure 16:
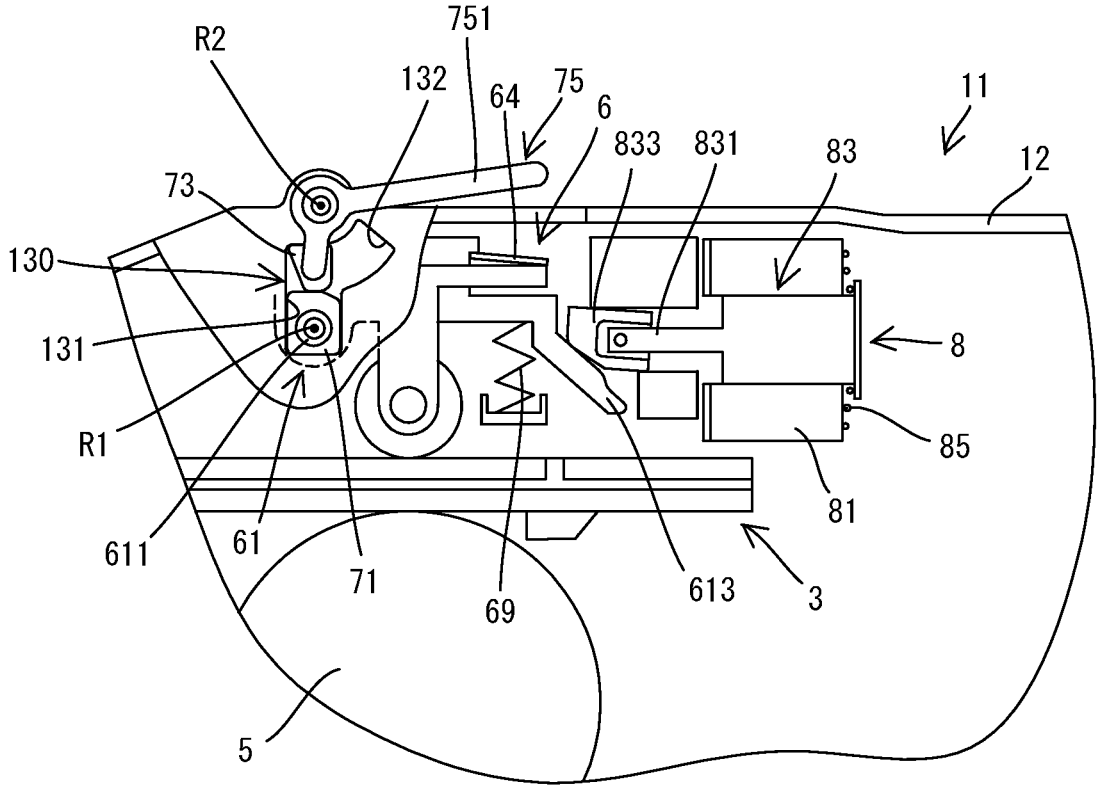
FIG. 16 is an explanatory drawing showing the driver, the pressing mechanism and the solenoid at the occurrence of jamming.

The driver 3 may be stopped (jammed) within the driver passage for some reason (for example, jamming of the nail 101) in the moving process of the driver 3 from the initial position to the nail-driving position. For example, the driver 3 may be stopped when the roller 63 is located on the straight part 33 as shown in FIG. 16. In such a case, the return mechanism (not shown) cannot return the driver 3 to the initial position even if the motor 2 is stopped, since the roller 63 is biased by the compressed biasing spring 64 and strongly pressing the driver 3 against the flywheel 5. Therefore, in the present embodiment, the pressing unit 60 can be moved in the up-down direction relative to the body housing 12 by an operation of the lever 75 by a user, as described above, in order to eliminate jamming. Operation of the pressing unit 60 by an operation of the lever 75 by a user is now described.

Figure 17:
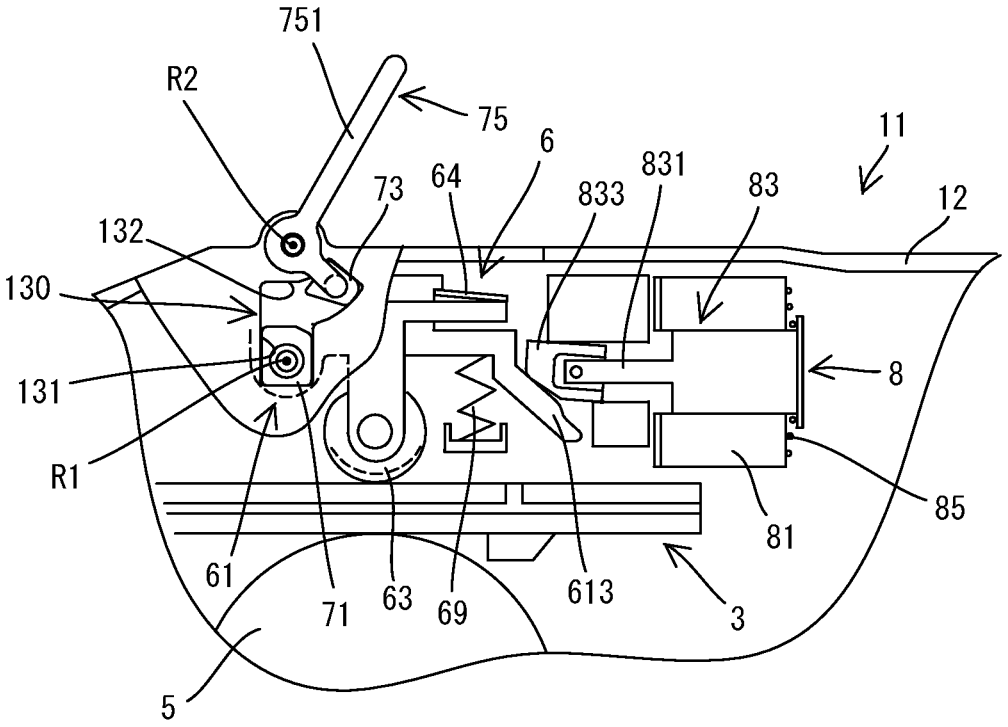
FIG. 17 is an explanatory drawing for illustrating a state in which lock of a support block is released by an operation of a lever by a user.
Figure 18:
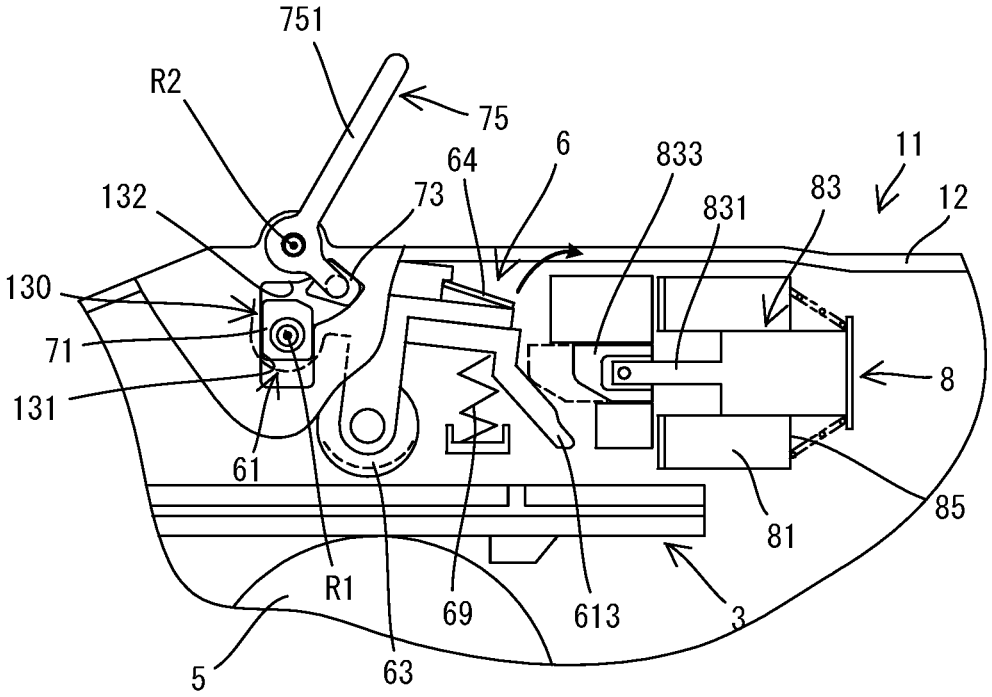
FIG. 18 is an explanatory drawing for illustrating a state in which the support block is moved upward.

As described above, a nailing operation is performed with the lever 75 located in the lock position. At this time, as shown in FIG. 16, the support blocks 71 are locked in the lowermost positions (normal positions) by the corresponding locking blocks 73. Further, as described above, the plunger 83 is held in the actuation position by the turnable part 833. From this state, as shown in FIG. 17, a user may turn the lever 75 to the unlock position to release the lock of the support blocks 71. As a result, as shown in FIG. 18, at the same time when the compressed biasing spring 64 is restored, the holder base 61 turns in the clockwise direction as viewed from the left (in the direction of an arrow in FIG. 18) around the contact position between the turnable part 833 and the press-receiving part 613, and the support blocks 71 move upward. Thus, the pressing of the roller 63 against the driver 3 can be released, so that the return mechanism (not shown) is allowed to return the driver 3 to the initial position. Further, as described above, the plunger 83 can also be returned to the initial position by the biasing force of the return spring 85. Although not shown, the holder base 61 biased by the biasing spring 69 turns to a position where the upper surface of the press-receiving part 613 abuts on the turnable part 833.

Thereafter, when the user returns the lever 75 to the lock position, the locking blocks 73 push down the support blocks 71 while turning the holder base 61, in the process of moving downward and forward within the second portion 132. At this time, the curved lower end surface of the locking block 73 abuts on the inclined surface of the upper rear end portion of the support block 71, thus smoothly pushing down the support block 71. The pressing unit 60 returns to a state as shown in FIG. 4 in which the support blocks 71 are located in their lowermost positions and the holder base 61 is in the separate position. The nailing machine 1 is thus back to a state in which it is capable of performing a nailing operation.

As described above, the nailing machine 1 of the present embodiment includes the tool body 11, the flywheel 5, the driver 3, the pressing mechanism 6 and the solenoid 8. The driver 3 is configured to linearly move forward from the initial position along the moving axis A1 by rotational energy transmitted from the flywheel 5 to thereby strike and drive a nail 101 into the workpiece. The pressing mechanism 6 is disposed on the side opposite to the flywheel 5 across the driver 3. The pressing mechanism 6 includes the holder base 61 which is turnably supported around the rotation axis R1 relative to the tool body 11, and the roller 63 which is rotatably supported by the holder base 61 via the roller holder 62. The holder base 61 is turnable between the separate position where the roller 63 is apart from the driver 3 and the pressing position where the roller 63 abuts on the driver 3 and presses the driver 3 toward the flywheel 5 to thereby enable transmission of the rotational energy from the flywheel 5 to the driver 3. The solenoid 8 has the plunger 83 which is configured to linearly move forward from the initial position when the solenoid 8 is activated. The plunger 83 is configured to move the holder base 61 from the separate position to the pressing position while moving forward from the initial position.

With such a structure, the solenoid 8 can turn the holder base 61 to cause the roller 63 supported by the holder base 61 to press the driver 3, thereby enabling transmission of the rotational energy to the driver 3. In a system in which a driver is pushed out by a lever forward along a moving axis to a position to enable transmission of rotational energy from a flywheel, it is relatively difficult to adjust the position of the driver. Compared with such a system, in the present embodiment, it is relatively easy to turn the holder base 61 to a position where the roller 63 reliably presses the driver 3. Therefore, the nailing machine 1 can realize more reliable transmission of the rotational energy to the driver 3. Further, the moving path of the driver 3 can be shortened compared with the above-described system, since the driver 3 never moves forward without receiving the rotational energy.

Further, in the nailing machine 1, the holder base 61 can be turned by the solenoid 8 of a simple structure which realizes simple linear motion of the plunger 83. Particularly, in the present embodiment, the solenoid 8 is disposed such that the moving axis A2 of the plunger 83 extends in parallel to the moving axis A1 of the driver 3. Thus, the driver 3 and the solenoid 8 can be arranged compactly along the front-rear direction, and the width of the tool body 11 in the left-right direction can be made relatively small.

Further, in the present embodiment, the roller 63 is supported via the roller holder 62 so as to be movable upward relative to the holder base 61 located in the pressing position. The driver 3 includes the cam parts 32 each having a thickness in the up-down direction gradually increasing toward the rear. Further, the pressing mechanism 6 includes the biasing spring 64 which is configured to bias the roller 63 toward the driver 3 by the elastic force being increased while the roller 63 is moved upward along with the forward movement of the cam parts 32. Therefore, the pressing force against the driver 3 can be increased along with the movement of the driver 3, so that further reliable transmission of the rotational energy can be realized. Further, a disc spring is used for the biasing spring 64, so that it is capable of generating a large load while requiring a relatively small space.

Further, in the present embodiment, the holder base 61 is supported by the tool body 11 (the support walls 13) via the shafts 611. The shafts 611 are movable away from the driver 3 relative to the tool body 11 (that is, upward). Therefore, when the driver 3 becomes impossible to move (or jammed) while the holder base 61 is in the pressing position, the pressing of the roller 63 against the driver 3 can be released by moving the shafts 611, so that the driver 3 can be moved. Particularly, in the present embodiment, the shafts 611 can be moved by the biasing force of the biasing spring 64 according to an operation of turning the lever 75 by a user. Thus, the user can eliminate jamming by only a simple operation.

Correspondences between the features of the above-described embodiment and the features of the invention are as follows. However, the features of the above-described embodiment are mere examples and thus do not limit the features of the invention. The nailing machine 1 is an example of the "driving tool". The nail 101 is an example of the "fastener". The tool body 11 is an example embodiment that correspond to the "tool body". The flywheel 5 is an example of the "flywheel". The driver 3 is an example of the "driver". The moving axis A1 is an example of the "moving axis of the driver". The pressing mechanism 6 is an examples of the "pressing mechanism". The solenoid 8 and the plunger 83 are examples of the "solenoid" and the "actuation part", respectively. The holder base 61 and the roller 63 are examples of the "holder" and the "roller", respectively. The rotation axis R1 is an example of the "rotation axis". The separate position and the pressing position of the holder base 61 are examples of the "first position" and the "second position", respectively. The biasing spring 69 is an example of the "first biasing member". The cam part 32 is an example of the "cam part". The biasing spring 64 is an example of the "second biasing member". The return spring 85 is an example of the "third biasing member". The rod part 831 and the turnable part 833 are examples of the "rod part" and the "turnable part", respectively. The upper guide 136 and the lower guide 137 are an example of the "pair of guide parts". The roller holder 62 is an example of the "roller-support member". The moving axis A2 is an example of the "moving axis of the actuation part". The shaft 611 is an example of the "shaft". The support block 71 is an example of the "movable member". The lever 75 and the locking block 73 are examples of the "operation member" and the "lock member".

The above-described embodiment is merely an example, and a driving tool according to the present invention is not limited to the structure of the nailing machine 1 of the above-described embodiment. For example, the following modifications or changes may be made. Further, only one or more of these modifications or changes may be applied in combination with the nailing machine 1 of the above-described embodiment or the claimed invention.

The driving tool may be a driving tool for driving out a fastener other than the nail 101. For example, the driving tool may be embodied as a tacker or a staple gun for driving out a rivet, pin or staple. Further, the driving source of the flywheel 40 is not particularly limited to the motor 2. For example, an AC motor may be adopted in place of the DC motor. A motor having a brush may be adopted.

The structure of the driver 3 may be appropriately changed. For example, the cam part 32 of the roller-abutting part 31 of the driver 3 may be formed linearly in its entirety, or in a gentle circular arc shape at least in part, when viewed from the side. In other words, an upper surface of the cam part 32 (an abutment surface which abuts on the roller 63) may be flat or curved in its entirety, or flat or curved in part. Further, the cam part 32 may have an inclination which varies halfway. The cam part 32 may be formed longer than that in the above-described embodiment, or the roller-abutting part 301 may include a plurality of cam parts each having a thickness gradually increasing toward the rear. The driver 3 may include a single roller-abutting part 31, in place of the pair of roller-abutting parts 31. Further, the shape and arrangement of the striking part 34 and the arms 35 may be appropriately changed.

Various modifications may also be made to the pressing mechanism 6.

For example, the holder base 61 and the roller holder 62 may have any selected shape. The holder base 61 does not need to be movable in the up-down direction, as long as the holder base 61 is turnably supported relative to the tool body 11 (the support wall 13). Specifically, the holder base 61 may be turnably supported by the tool body 11, the support wall 13 or other member fixed to the tool body 11 directly via the shafts 611 (or a separate shaft from the holder base 61). In a case where the holder base 61 is movable in the up-down direction, a structure for moving the holder base 61 in the up-down direction is not limited to the locking blocks 73 and the lever 75.

The number of the roller 63 is not limited to one, but may be more (for example, two).

The biasing spring 64 does not need to be a disc spring, but may be a spring of a different kind (such as a compression coil spring, a tension coil spring, a flat spring and a torsion spring). Further, the biasing spring 64 may be a spring having a linear characteristic.

Furthermore, a plurality of biasing springs 64 may be provided.

Similarly, the biasing spring 69 may be a spring of a different kind (such as a tension coil spring, a flat spring, a torsion spring and a disc spring). Further, the arrangement position and the number of the biasing spring 69 may also be appropriately changed.

Various modifications may also be made to the solenoid 8. For example, the turnable part 833 may be omitted, as long as the front end portion of the plunger 83 is linearly movable to turn the holder base 61 from the separate position to the pressing position when the solenoid 8 is activated. The front end portion of the plunger 83 may be configured to turn the holder base 61 via a member other than the turnable part 833. The solenoid 8 may be disposed, for example, in front of the pressing mechanism 6, or such that the moving axis of the plunger 83 extends in a direction other than the front-rear direction.

Further, in the above-described embodiment, the driver-driving mechanism 4 is employed in which the roller 63 presses the driver 3 directly against the flywheel 5 and thereby enables transmission of the rotational energy to the driver 3. The rotational energy may, however, be transmitted from the flywheel 5 to the driver 3 via a transmitting member disposed between the driver 3 and the flywheel 5. For example, a driver-driving mechanism may be employed which includes a ring-like transmitting member which is disposed radially outside of the flywheel 5. In this case, when the roller 63 presses the driver 3 toward the flywheel 5, the driver 3 and the flywheel 5 are both frictionally engaged with the ring-like member, so that the rotational energy is transmitted from the flywheel 5 to the driver 3. Such a driver-driving mechanism is disclosed, for example, in Japanese Unexamined Patent Application Publication No. 2018-12187.

Further, in view of the nature of the present invention and the above-described embodiment, the following features (aspects) are provided. Only one or more of the following features may be adopted in combination with any of the nailing machine 1 of the above-described embodiment, its modifications and the claimed invention.

(Aspect 1)

The second biasing member is disposed between the holder and the roller.

(Aspect 2)

The solenoid is disposed rearward of the pressing mechanism.

(Aspect 3)

The turnable part is configured to be turned by receiving a biasing force of the first biasing member via the holder when the holder is located in the second position, thereby generating resistance, and the third biasing member is configured to return the actuation part to the initial position against the biasing force of the first biasing member.

DESCRIPTION OF NUMERALS

1: nailing machine, 2: motor, 3: driver, 4: driver-driving mechanism, 5: flywheel, 6: pressing mechanism, 8: solenoid, 11: tool body, 12: body housing, 13: support wall, 14: nose part, 17: handle, 18: controller, 19: magazine, 21: pulley, 25: belt, 30: body, 31: roller-abutting part, 32: cam part, 33: straight part, 34: striking part, 35: arm, 51: pulley, 60: pressing unit, 61: holder base, 62: roller holder, 63: roller, 64: biasing spring, 65: fastening member, 69: biasing spring, 71: support block, 73: locking block, 75: lever, 81: coil, 83: plunger, 85: return spring, 100: battery, 101: nail, 120: outlet, 121: stopper, 123: stopper, 125: contact arm, 130: guide groove, 131: first part, 132: second part, 134:

spring-receiving part, 136: upper guide, 137: lower guide, 138: passage, 171: trigger, 172: switch, 175: battery-mounting part, 611: shaft, 613: press-receiving part, 615: threaded hole, 616: through hole, 621: spring-receiving part, 625: leg, 626: shaft, 651: flange part, 653: male thread part, 751: operation part, 752: support pin, 754: arm, 831: rod part, 833: turnable part, 834: inclined surface, A1: moving axis, A2: moving axis, R1: rotation axis, R2: rotation axis, R3: rotation axis

What is claimed is:

1. A driving tool configured to drive a fastener into a workpiece, the driving tool comprising:

a tool body;

a flywheel housed in the tool body;

a driver disposed to face an outer periphery of the flywheel and configured to linearly move forward from an initial position along a moving axis by rotational energy transmitted from the flywheel, thereby striking and driving the fastener into the workpiece, the moving axis defining a front-rear direction of the driving tool;

a pressing mechanism disposed on a side opposite to the flywheel across the driver in a facing direction in which the flywheel and the driver face each other; and a solenoid having an actuation part, the actuation part being configured to linearly move in a specified direction from an initial position when the solenoid is activated, wherein:

the pressing mechanism includes:

a holder turnably supported around a rotation axis relative to the tool body; and a roller rotatably supported by the holder, the holder is turnable between a first position in which the roller is apart from the driver and a second position in which the roller abuts on the driver and presses the driver toward the flywheel to thereby enable transmission of the rotational energy to the driver, the actuation part is configured to turn the holder from the first position to the second position while moving from the initial position, the roller is supported to be movable in the facing direction relative to the holder located in the second position, the driver includes a cam part, the cam part having a thickness in the facing direction, the thickness gradually increasing toward a rear end of the cam part, and the pressing mechanism further includes a second biasing member configured to bias the roller toward the driver by an elastic force, the elastic force being increased while the roller is moved in the facing direction along with forward movement of the cam part.

2. The driving tool as defined in claim 1, further comprising a first biasing member configured to bias the holder toward the first position.

3. The driving tool as defined in claim 1, wherein:

the solenoid further has a third biasing member configured to bias the actuation part toward the initial position, the actuation part includes:

a rod part linearly movable in an axial direction of the rod part; and a turnable part turnably connected to a front end portion of the rod part and configured to abut on the holder and move the holder to the second position along with movement of the actuation part from the initial position, and the turnable part is configured to be turned by receiving a biasing force of the second biasing member via the holder when the holder is located in the second position, thereby generating resistance and preventing the actuation part from returning to the initial position by a biasing force of the third biasing member.

4. The driving tool as defined in claim 3, wherein:

the tool body includes a pair of guide parts, the pair of guide parts are arranged on opposite sides of the turnable part in the facing direction and define a passage for the turnable part, and the turnable part is configured to be turned by receiving the biasing force of the second biasing member and abut on the guide parts, thereby generating the resistance.

5. The driving tool as defined in claim 4, wherein a front end of the turnable part is located forward of a front end of the pair of guide parts when the holder is in the second position.

6. The driving tool as defined in claim 1, wherein the second biasing member is a disc spring.

7. The driving tool as defined in claim 6, wherein the disc spring has a nonlinear characteristic.

8. The driving tool as defined in claim 1, wherein:

the pressing mechanism further includes a roller-support member configured to rotatably support the roller, and the holder is configured to support the roller-support member such that the roller support member is movable in the facing direction.

9. The driving tool as defined in claim 8, wherein:

the second biasing member is disposed between the holder and the roller-support member and configured to bias the roller-support member toward the driver relative to the holder.

10. The driving tool as defined in claim 1, wherein a moving axis of the actuation part extends in parallel to the moving axis of the driver.

11. The driving tool as defined in claim 1, wherein the rotation axis of the holder extends orthogonally to the moving axis of the driver.

12. The driving tool as defined in claim 1, wherein:

the holder is supported by the tool body via a shaft, and the shaft is movable in a direction away from the driver relative to the tool body.

13. The driving tool as defined in claim 12, further comprising:

a movable member supported to be movable in the facing direction, wherein:

the shaft is supported by the movable member so as to be rotatable around the rotation axis.

14. The driving tool as defined in claim 13, further comprising:

an operation member configured to be externally operable by a user; and a lock member configured to move between a lock position in which the lock member locks the movable member in a specified position and an unlock position in which the lock member allows the movable member to move away from the driver according to an operation of the operation member.

15. The driving tool as defined in claim 14, wherein the movable member is configured to move away from the driver by the elastic force of the second biasing member while the lock member moves from the lock position to the unlock position.

16. A driving tool configured to drive a fastener into a workpiece, the driving tool comprising:

a tool body;

a flywheel housed in the tool body;

a driver disposed to face an outer periphery of the flywheel and configured to linearly move forward from an initial position along a moving axis by rotational energy transmitted from the flywheel, thereby striking and driving the fastener into the workpiece, the moving axis defining a front-rear direction of the driving tool;

a pressing mechanism disposed on a side opposite to the flywheel across the driver in a facing direction in which the flywheel and the driver face each other; and a solenoid having an actuation part, the actuation part being configured to linearly move in a specified direction from an initial position when the solenoid is activated, wherein:

the pressing mechanism includes:

a holder turnably supported around a rotation axis relative to the tool body; and a roller rotatably supported by the holder, the holder is turnable between a first position in which the roller is apart from the driver and a second position in which the roller abuts on the driver and presses the driver toward the flywheel to thereby enable transmission of the rotational energy to the driver, the actuation part is configured to turn the holder from the first position to the second position while moving from the initial position, when the holder is located in the second position, a distance between the rotation axis of the holder and a first contact position is shorter than a distance between the rotation axis and a second contact position, the first contact position being a position of contact between the roller and the driver, the second position being a position of contact between the actuation part and the holder.

* * * * *